US008262359B2

(12) United States Patent
Palmer et al.

(10) Patent No.: US 8,262,359 B2
(45) Date of Patent: Sep. 11, 2012

(54) DIAPHRAGM FOR TURBOMACHINES AND METHOD OF MANUFACTURE

(75) Inventors: Bryan Roy Palmer, Rugby (GB); David Littlewood, Rugby (GB); David Paul Blatchford, Rugby (GB); Peter Frank Critchley, Rugby (GB); Adrian Lord, Rugby (GB)

(73) Assignee: ALSTOM Technology Ltd., Baden (CH)

( * ) Notice: Subject to any disclaimer, the term of this patent is extended or adjusted under 35 U.S.C. 154(b) by 1280 days.

(21) Appl. No.: 11/972,774

(22) Filed: Jan. 11, 2008

(65) Prior Publication Data

US 2008/0170939 A1 Jul. 17, 2008

Related U.S. Application Data

(60) Provisional application No. 60/880,273, filed on Jan. 12, 2007.

(51) Int. Cl.
*F01D 5/22* (2006.01)

(52) U.S. Cl. ..... 416/191; 416/195; 416/214 R

(58) Field of Classification Search ..... 415/139, 415/191, 193, 208.1, 209.2, 209.3, 209.4; 416/191, 193 R, 193 A, 195, 214 A, 215, 416/219 R See application file for complete search history.

(56) References Cited

U.S. PATENT DOCUMENTS

| | | | | |
|---|---|---|---|---|
| 1,304,793 | A * | 5/1919 | Moore | 416/191 |
| 4,025,229 | A * | 5/1977 | Browning et al. | 415/209.4 |
| 4,509,238 | A | 4/1985 | Lee et al. | |
| 4,576,551 | A * | 3/1986 | Olivier et al. | 416/191 |
| 4,840,539 | A * | 6/1989 | Bourcier et al. | 416/191 |
| 7,168,919 | B2 | 1/2007 | Blatchford et al. | |
| 7,186,074 | B2 | 3/2007 | Blatchford et al. | |

FOREIGN PATENT DOCUMENTS

| | | |
|---|---|---|
| DE | 10108005 | 8/2002 |
| JP | 9-053410 | 3/1997 |
| JP | 2001-221007 | 8/2001 |
| JP | 2008-144687 | 6/2008 |
| WO | WO01/71165 | 9/2001 |
| WO | WO2006/100256 | 9/2006 |

OTHER PUBLICATIONS

International Search Report and Written Opinion of the International Searching Authority for PCT Patent App. No. PCT/EP2008/050130 (Jun. 17, 2008).

* cited by examiner

*Primary Examiner* — Edward Look

*Assistant Examiner* — Aaron R Eastman

(74) *Attorney, Agent, or Firm* — Cermak Nakajima LLP; Adam J. Cermak

(57) ABSTRACT

A turbine diaphragm includes an annulus of static blades and an outer diaphragm ring surrounding the annulus of static blades and welded to the outer platforms. Each static blade has an inner platform, an aerofoil, and an outer platform. The inner platforms serve the function of an inner diaphragm ring, thereby reducing material and manufacturing costs. Furthermore, confronting edges of the inner platforms have an interference fit with each other and the aerofoils are in a state of torsional stress between the inner and outer platforms. The latter two features improve the dynamic characteristics of the diaphragm.

15 Claims, 6 Drawing Sheets

DIAPHRAGM FOR TURBOMACHINES AND METHOD OF MANUFACTURE

This application claims priority under 35 U.S.C. §119 to U.S. Provisional application No. 60/880,273, filed 12 Jan. 2007, the entirety of which is incorporated by reference herein.

BACKGROUND

1. Field of Endeavor

The present invention relates to a novel construction for diaphragms of the type used in axial flow turbomachines. It is particularly, but not exclusively, relevant to steam turbine diaphragms.

2. Brief Description of the Related Art

The present invention is related to the so-called "platform" type of diaphragm construction, see FIGS. 1A and 1B. FIG. 1A is a perspective view of a static blade or vane, and FIG. 1B is a view on a radial section of a diaphragm during manufacture, including the static blade. In this type of diaphragm, the ends of the aerofoils 1 are integral with radially inner and outer "platforms" 2, 3, the aerofoils and platforms being machined from solid. In FIG. 1A, an adjacent blade shape is shown in dashed lines, a complete annulus of static blades being built up by assembling successive combined aerofoil/platform components 4 into an annular array between inner and outer diaphragm rings 5, 6 and welding the platforms to the diaphragm rings. The inner and outer diaphragm rings and platforms are further machined as appropriate to accommodate turbine sealing features and to fit adjacent turbine features. When the assembly is finished, the inner and outer platforms 2, 3 form the inner and outer port walls of the diaphragm.

The current practice for HP and IP steam turbines employing platform construction is to build the blades onto the inner diaphragm ring and then to shrink the outer diaphragm ring on to the blades. In current designs, the inner diaphragm ring is required to support the static blades and to give the diaphragm rigidity against forces that tend to distort it during assembly and operation of the turbine.

SUMMARY

According to one of numerous aspects of the present invention, a turbine diaphragm comprises:

an annulus of static blades, each static blade comprising an inner platform, an aerofoil, and an outer platform; and an outer diaphragm ring surrounding the annulus of static blades and welded to the outer platforms;

wherein the inner platforms serve the function of an inner diaphragm ring, confronting edges of the inner platforms have an interference fit with each other and the aerofoils are in a state of torsional stress between the inner and outer platforms.

Interference between the inner platforms produces a rigid band around the inner diameter of the completed diaphragm, which favourably influences its dynamic behaviour.

Another aspect of the present invention elimination of the prior art inner diaphragm ring and the welds that attach it to the blade inner platform, thus reducing the material and manufacturing requirements for the diaphragm. Furthermore, elimination of the inner diaphragm ring, with accompanying increase in the radius of the turbine rotor against which the inner platforms must seal, reduces the total pressure load of the turbine working fluid on the diaphragm.

There may be a tapered interface between the inner diameter of the diaphragm ring and the outer diameter of the outer platforms.

Torsional stress in the aerofoils is achieved during assembly of the diaphragm by:

initially assembling the annulus of blades so that selected confronting edge portions of neighbouring inner platforms are in contact with each other, while all confronting edge portions of neighbouring outer platforms have clearances between them; and radially compressing the blade ring with the diaphragm ring to a predetermined final diameter by forcible contact between an internal surface of the diaphragm ring and external surfaces of the outer platforms, so that clearances between selected confronting edge portions of the neighbouring outer platforms are closed up, the contact between the selected confronting edge portions of the neighbouring inner platforms becomes an interference fit, and an elastic torsional stress is built into the aerofoils.

This pre-stressing of the diaphragm assembly favourably influences the blade dynamic behaviour.

To ensure that the entire torsional load in the diaphragm assembly is confined to the blade annulus and that only a radially outward load from the blade annulus is experienced by the diaphragm ring, the selected confronting edge portions of neighbouring outer platforms, between which contact occurs when the diaphragm ring is forced on to the outer platforms, comprise an edge portion that is axially aligned and an edge portion that is inclined with respect to the circumferential direction.

The above features result in a diaphragm having reduced welding and material requirements in comparison with the prior art, whilst having equivalent static strength and good predictability of dynamic behaviour in operation.

Further aspects of the invention will be apparent from a perusal of the following description.

BRIEF DESCRIPTION OF THE DRAWINGS

Exemplary embodiments of the invention will now be described, with reference to the accompanying drawings, in which.

DETAILED DESCRIPTION OF EXEMPLARY EMBODIMENTS

Figure 1A:
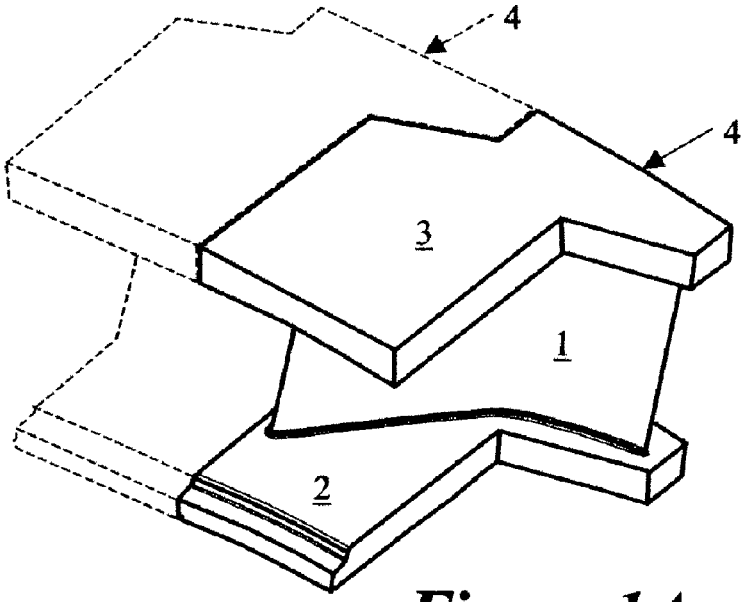
Figure 1A (Prior Art)
FIGS. 1A and 1B illustrate the prior art "platform" type of turbine diaphragm construction, FIG. 1A being a perspective view of a static blade or vane, and FIG. 1B being a partial view on a radial section of a diaphragm during the manufacturing process.
Figure 1B:
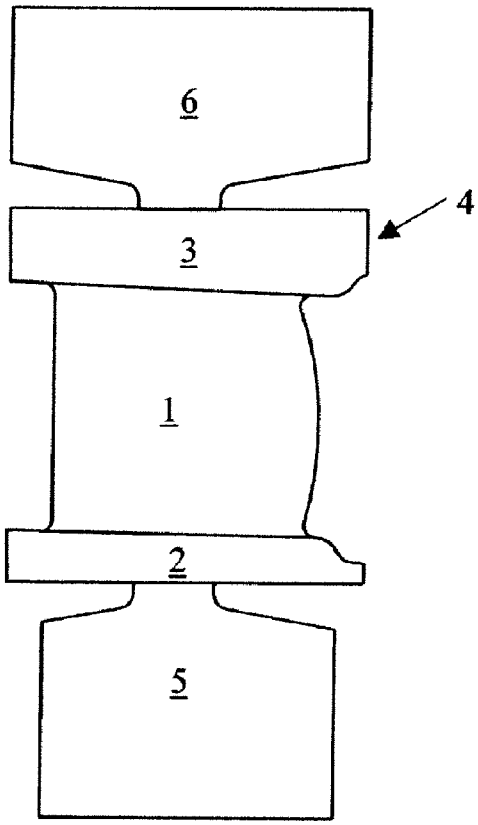
Figure 1B (Prior Art)
Figure 2:
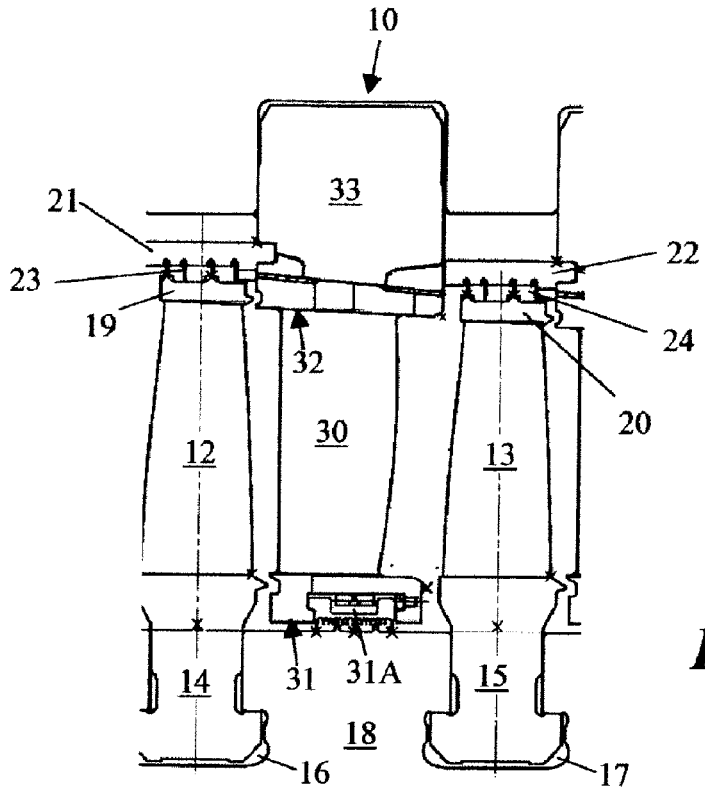
FIG. 2 shows a partial radial sectional view of two moving turbine blade rows, and a fully assembled turbine diaphragm in accordance with the invention, located between the moving blade rows.

FIG. 2 is partial radial sectional sketch of an embodiment of the invention, showing a fully assembled diaphragm 10 located between successive annular rows of moving blades 12, 13 in a steam turbine. The moving blades are each provided with radially inner "T-root" portions 14, 15 located in corresponding slots 16, 17 machined in the rim of a rotor drum 18. They are also provided with radially outer shrouds 19, 20 that seal against circumscribing segmented rings 21, 22. As known, sealing between the 19, 20 shrouds and the rings 21, 22 is accomplished by fins 23, 24, which are caulked into grooves machined in the rings 21, 22.

Figure 3A:
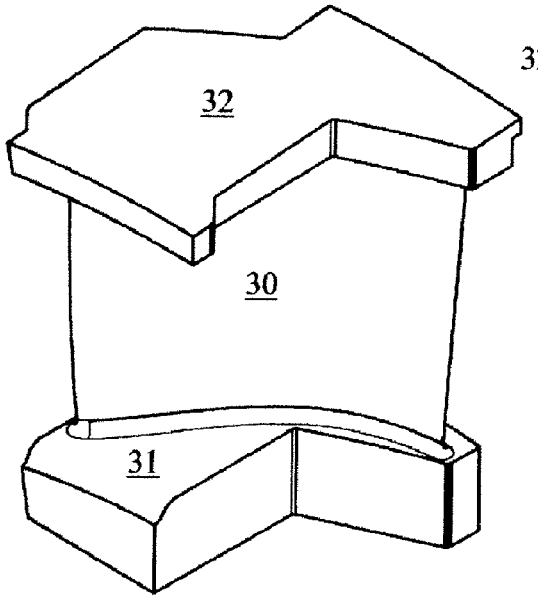
FIGS. 3A and 3B are isometric perspective views of a single static blade from a diaphragm similar to that shown in FIG. 2, FIG. 3A being a view on the concave (pressure) side of the blade aerofoil and FIG. 3B being a view on the convex (suction) side of the blade aerofoil.
Figure 3B:
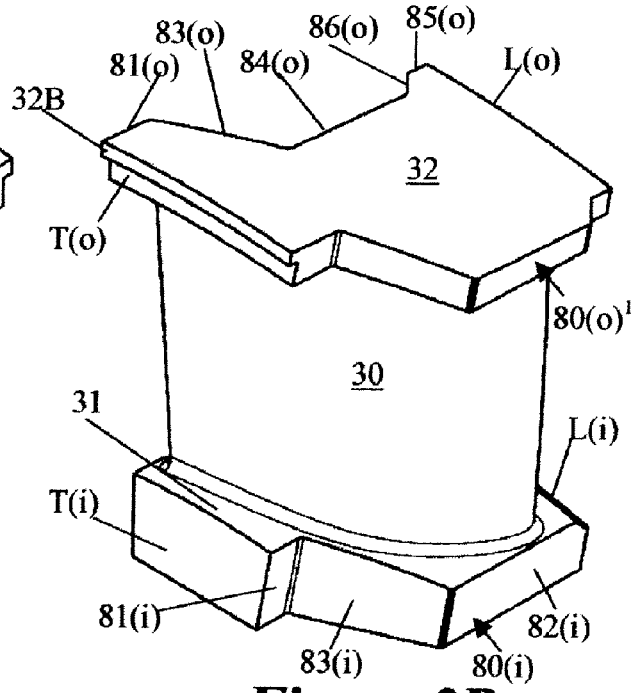

Diaphragm 10 comprises an annular row of static blades, each having an aerofoil 30 whose radially inner and outer ends are integral with radially inner and outer platforms 31, 32, respectively. FIGS. 3A and 3B are pictorial views of the opposite sides of a static blade before it is assembled into a diaphragm, showing the shapes of the inner and outer platforms 31, 32. During manufacture, the radially outer surfaces of platforms 32 are welded onto the inner diameter of a massive outer diaphragm ring 33, which stiffens the diaphragm and controls its thermal expansion and contraction during operation of the turbine. However, in distinction from the prior art, there is no massive inner diaphragm ring. Instead, the inner platforms 31 are made thick enough to house a floating labyrinth seal 31A or the like, which seals between the diaphragm 10 and the rotor drum 18.

Another feature embodying principles of the present invention is that the shapes and relative dimensions of the inner and outer platforms 31, 32, and the assembly process for the diaphragm 10, as described below, enable the aerofoils to be subjected to a degree of twist between their radially inner and outer ends; i.e., compared to their condition before assembly into the diaphragm, the assembly process rotates the inner platforms 31 slightly relative to the outer platforms 32 about an axis of twist running roughly radially through each blade. This pre-stresses the blades, which has a favourable effect on the dynamic behaviour of the blades under load.

Figure 8A:
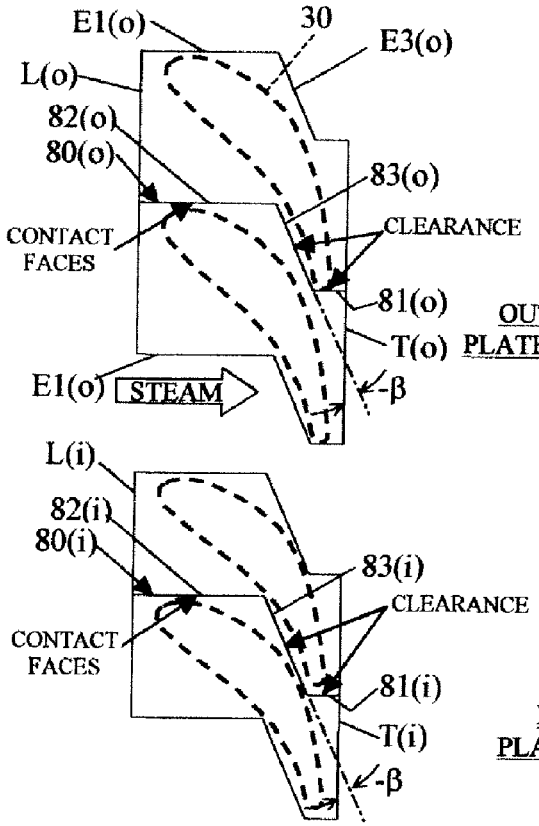
Figure 8A Prior Art
FIGS. 8A and 8B compare inter-platform clearances and contacts in a prior art platform type of turbine diaphragm construction with those in a construction in accordance with the present invention.
Figure 8B:
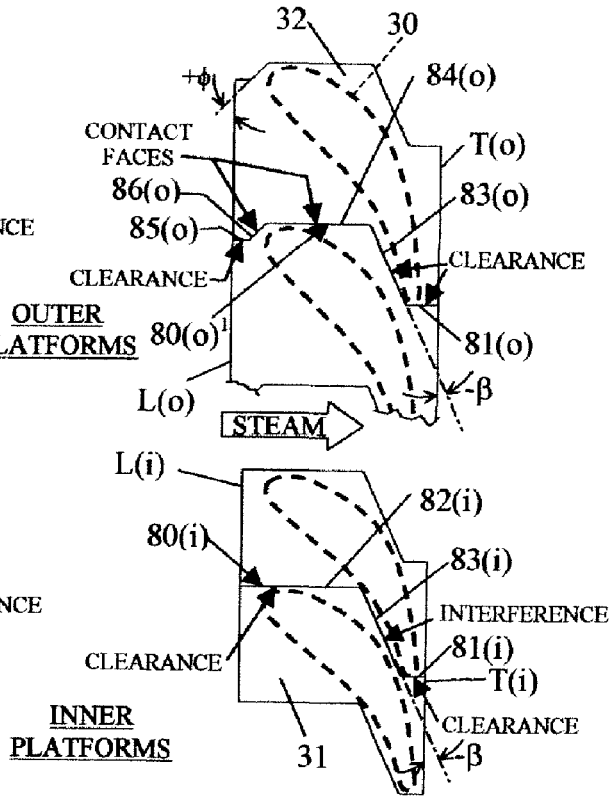

FIG. 8A illustrates contacts and clearances between neighbouring platforms in a finished prior art construction and FIG. 8B illustrates contacts and clearances for a finished construction of the present invention. In the diagrams, the approximate positions of the aerofoils 30 relative to the platforms 31, 32 are shown in dashed lines. As one would expect, the inner platforms are narrower in the circumferential direction than the outer platforms. The inner and outer platforms in FIG. 8A have the same axial width. In FIG. 8B, the axial width of the outer platforms is shown as being greater than the axial width of the inner platforms, though they could also be of the same width. Neighbouring inner and outer platforms in both FIGS. 8A and 8B have an interlocking zigzag or cranked shape along their interfaces when seen in plan view. The inner platforms 31 have circumferentially extending leading and trailing edges L(i), T(i), relative to the steam flow through the turbine passages, whose direction is shown by the block arrows. Similarly, the circumferentially extending leading and trailing edges of the outer platforms 32 are labelled L(o), T(o).

As seen in plan view, the cranked shape of the interface between the inner platforms in FIG. 8A is achieved in that the mutually confronting edges 80(*i*) of neighbouring platforms include first and second, respectively shorter and longer, axially aligned edge portions 81(*i*) and 82(*i*) that are circumferentially offset from each other, forming first and second axially extending arms of the crank shape. In sequence from the trailing edge T(i) to the leading edge L(i) of each inner platform, the first axially aligned edge portion 81(*i*) is followed by an inclined edge portion 83(*i*) that forms the inclined arm of the crank shape and connects the first axially aligned edge portion 81(*i*) to the second axially aligned edge portion 82(*i*). If the circumferential direction is taken as a datum, with degrees of arc away from the datum in a clockwise sense being expressed as positive and degrees of arc away from the datum in an anti-clockwise sense being expressed as negative, the edge portion 83(*i*) is inclined at an angle $-\beta$ to the circumferential direction. In this example, $\beta$ is about 25 degrees, but may be more or less than this at the discretion of the designer. Similarly, the mutually confronting edges 80(*o*) of neighbouring outer platforms in FIG. 8A have first and second, axially aligned, circumferentially offset edge portions 81(*o*) and 82(*o*), respectively, connected by inclined edge portions 83(*o*).

We refer now to FIG. 8B, which illustrate features in accordance with the invention, and also to FIGS. 3A and 3B, which are pictorial views of a blade incorporating the same features. We first note that the inner platforms 31 have the same basic shape as described above for FIG. 8A, and the confronting edge portions that make up the cranked shape of the interface between their confronting platform edges are therefore similarly labelled. However, the outer platforms 32 are different, in that the interface between their confronting platform edges 80$(o)^1$ forms a double cranked shape. This is achieved in that platform edges 80$(o)^1$ each comprise first, second and third axially aligned edge portions 81(*o*), 84(*o*), and 85(*o*), respectively. These are circumferentially offset from each other, so forming first, second, and third axially extending arms of the crank shape. The first axially aligned edge portion 81(*o*) is shorter than the second axially aligned edge portion 84(*o*) and the third axially aligned edge portion 85(*o*) is shorter than the first axially aligned edge portion 81(*o*). In sequence from the trailing edge T(o) to the leading edge L(o) of each outer platform, the first axially aligned edge portion 81(*o*) is followed by a first inclined edge portion 83(*o*) that forms a first inclined arm of the crank shape and connects the first axially aligned edge portion 81(*o*) to the second axially aligned edge portion 84(*o*). Edge portion 84(*o*) is followed by a second inclined edge portion 86(*o*) that forms a second inclined arm of the crank shape and connects the second axially aligned edge portion 84(*o*) to the third axially aligned edge portion 85(*o*). As was the case for the inner platforms, the edge portion 83(*o*) is inclined at the angle $-\beta$ to the circumferential direction. However, the edge portion 86(*o*) is inclined at a different angle $+\phi$ to the circumferential direction. In this example, $\phi$ is about 45 degrees, but may be more or less than this at the discretion of the designer.

In FIG. 8B, the contacts and clearances between the above-described different portions of the confronting inner and outer platform edges 80(*i*) and 80(*o*) result from the above-mentioned twisting of the inner platforms 31 relative to the outer platforms 32 during assembly, as explained below.

In FIG. 8A, where no twisting force is exerted on the aerofoils during assembly of the diaphragm, the inner platforms are dimensioned so that in the fully assembled state:

there is a clearance between the first axially aligned, mutually confronting, edge portions 81(*i*);

there is a clearance between the inclined, mutually confronting, edge portions 83(*i*); and there is contact between the second axially aligned, mutually confronting, edge portions 82(*i*).

Qualitatively, the outer platforms in FIG. 8A have the same contact and clearance characteristics as the inner platforms, though clearances may differ in exact dimensional terms.

In contrast, FIG. 8B shows that the inner platforms are dimensioned so that in the fully assembled state:

there is a clearance between the first axially aligned, mutually confronting, edge portions 81(*i*);

there is a clearance between the second axially aligned mutually confronting, edge portions 82(*i*); and there is an interference contact between the inclined mutually confronting edge portions 83(*i*), this interference being obtained by oversizing the inclined edge portions relative to the prior art of FIG. 8A.

Moreover, the outer platforms in FIG. 8B are dimensioned so that in the fully assembled state:

there is a clearance between the first axially aligned, mutually confronting, edge portions 81(*o*);

there is a clearance between the first inclined mutually confronting edge portions 83(*o*).

there is a clearance between the third axially aligned, mutually confronting, edge portions 85(*o*);

there is contact between the second axially aligned, mutually confronting, edge portions 84(*o*); and there is contact between the second inclined, mutually confronting, edge portions 86(*o*).

The initial steps in manufacture of the diaphragm 10 are production of the diaphragm ring 33 and the static blades, the latter including aerofoils 30 formed integrally with inner and outer platforms 31, 32.

Figure 4:
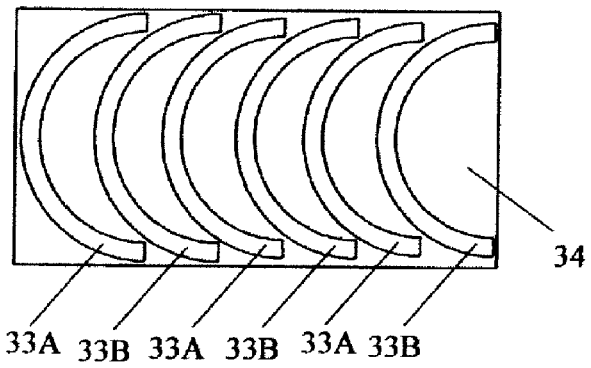
FIG. 4 illustrates the process of cutting a number of half diaphragm rings out of a metal plate, in accordance with the invention.

In a known method of manufacturing the diaphragm ring 33, it is cut out of heavy gauge steel plate as a complete ring, machined to a desired sectional profile, and then cut along a diameter into two semi-circular pieces to enable assembly and disassembly of the blades within its inner diameter. However, the preferred method for the present invention is to start by making the diaphragm ring in two halves 33A, 33B, by cutting each half ring separately from the plate material. As shown in FIG. 4, this allows more efficient use of the plate material, so reducing material costs, since the half-ring shapes 33A, 33B for cutting out from the plate 34 can be partially nested inside each other.

Figure 5:
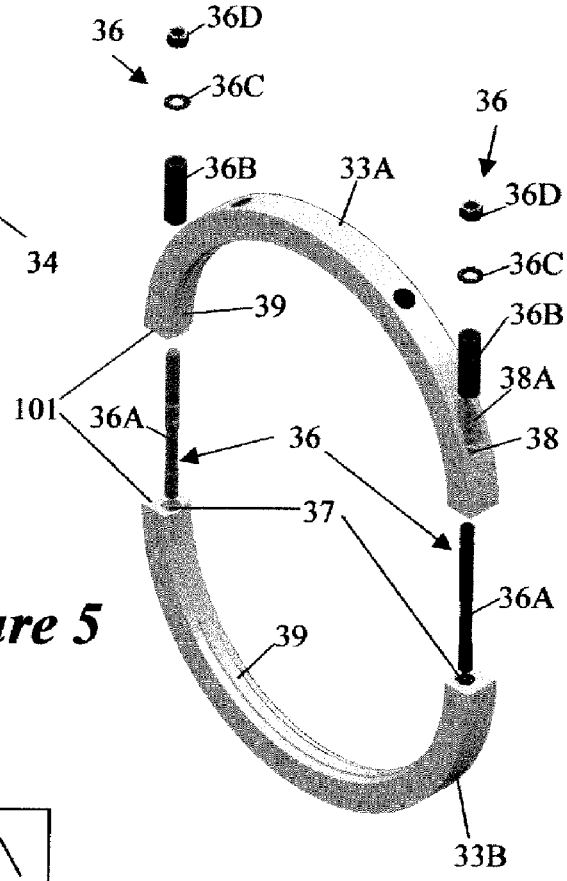
FIG. 5 illustrates the construction of a whole diaphragm ring from two half diaphragm rings.

As shown in FIG. 5, after machining of the half-rings 33A, 33B to an initial desired sectional profile that includes welding lands 39, their opposed ends are provided with bolt holes that each take a torque-tightened stud and spacer arrangement 36. Blind ended screw-threaded holes 37 are drilled in the diametrically opposed ends of the bottom half-ring 33B and screw-threaded holes 38 with recesses 38A are drilled through the diametrically opposed ends of the top half-ring 33A. To produce a complete diaphragm ring 33, the confronting ends 101 of the two half-rings 33A, 33B are drawn together into interfering contact with each other by inserting threaded studs 36A into the threaded holes 37, 38, putting spacers 36B and washers 36C over the ends of the studs 36A in the recesses 38A where the studs 36A project above the holes 38 in the half-ring 33A, and tightening clamping nuts 36D on the studs against the spacers 36B until a predetermined torque value is obtained.

Figure 6:
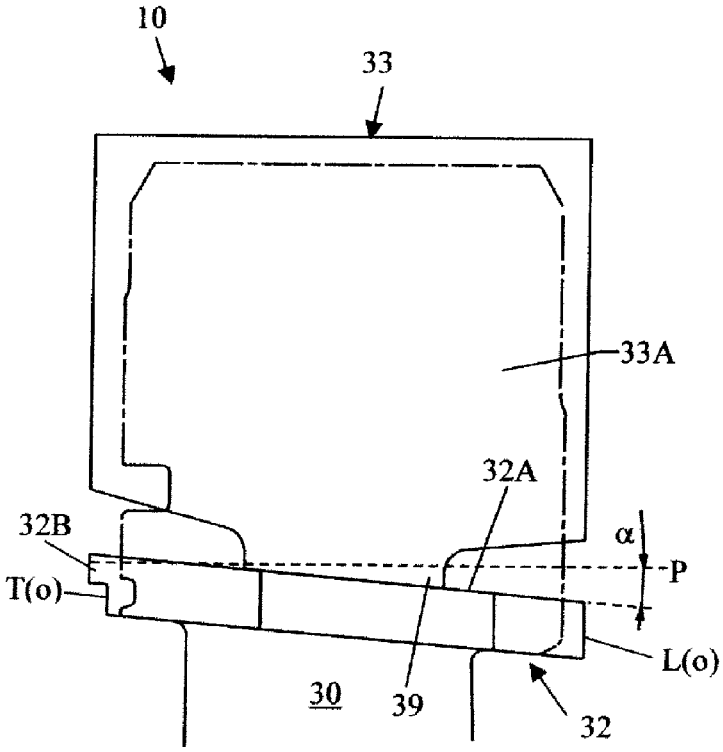
FIG. 6 is a radial section through the radially outer part of a turbine diaphragm assembly according to the invention.

Referring also to FIG. 6, the solid lines show the outline of the outer platform 32 and the diaphragm ring 33 after initial machining and assembly into a diaphragm and before final machining. The chain-dashed lines show their outlines after final machining to shape as a complete diaphragm. As already mentioned, after the basic shapes of the half-rings 33A, 33B have been cut from heavy-gauge plate, their inner circumferences are machined to produce raised lands 39, which facilitate later welding of the assembled diaphragm ring 33 to the outer platforms 32. It will also be noticed from FIG. 6 that in preparation for assembly, the inner surfaces of lands 39 on the half-rings and the outer surfaces 32A of outer platforms 32 have been machined so that the lands 39 have a taper angle, $\alpha$. In this particular example, the taper angle $\alpha$ is about 5° relative to a plane P parallel to the axis of rotation of the turbine rotor. However, the angle $\alpha$ could be more or less than this, at the discretion of the designer, taking into account the diaphragm assembly technique to be adopted (see below), any axial taper of the outer platforms, and the fluid dynamic requirements of the turbine stage. For example, the outer platforms' thickness may be tapered in either an upstream or downstream axial direction, so reducing or increasing the taper angle $\alpha$ required for the lands 39. Furthermore, assuming an axially uniform outer platform thickness, the taper angle $\alpha$ depends on the flare angle of the outer wall of the turbine passage, this being the angle at which it converges towards, or diverges away from, the axis of rotation of the turbine rotor in the downstream direction. Note that in a steam turbine it is possible for high pressure (HP) turbine stages near the HP steam entry to exhibit negative flare, i.e., they may have a local angle of convergence. Hence, the taper angle $\alpha$ could also be negative for such a turbine stage.

Figure 7A:
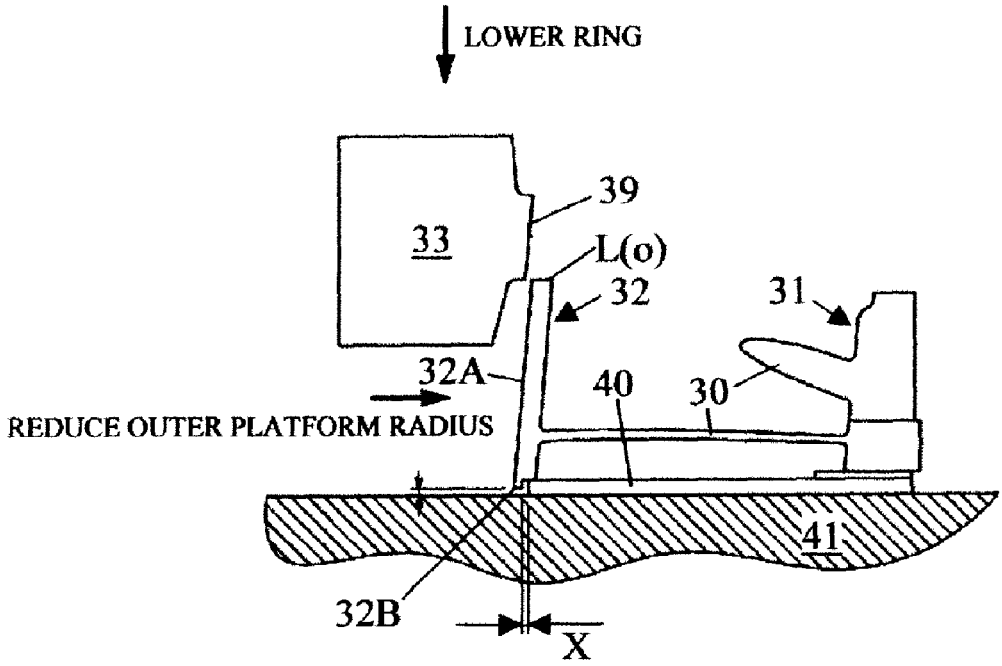
FIGS. 7A and 7B illustrate part of the process of assembling a turbine diaphragm according to the invention.

To begin assembly of a diaphragm 10 after preparatory machining, a ring of the static blades, including aerofoils 30 and inner and outer platforms 31, 32, are assembled on to a location plate 40 on a horizontal assembly table 41, as shown in the sectional side view of FIG. 7A. Referring also to FIGS. 3B and 8B, the blades are initially arranged so that the inclined edge portions 83(*i*) of neighbouring inner platforms 31 are in contact with each other, there being clearances between the other mutually confronting edge portions 81(*i*) and 82(*i*). With regard to the outer platforms 32, they describe a larger diameter than their final diameter, hence FIG. 7A shows that there is a radial clearance of X between the circumference of the location plate 40 and a lip 32B that delimits a location step on the edges of the outer platforms 32. Accordingly, there are clearances between the confronting edges 80$(o)^1$ of neighbouring outer platforms.

To continue assembly of this exemplary embodiment, the diaphragm ring 33 is held horizontally and concentrically with the ring of static blades, then lowered so that the inner surface of the welding land 39 slides evenly onto the outer surfaces 32A of the outer platforms 32. The diaphragm ring 33 is then forced further down onto the outer platforms 32, thereby bringing the second inclined, mutually confronting, edge portions 86(*o*), and the second axially extending, mutually confronting, edge portions 84(*o*) of neighbouring outer platforms into contact. However, small clearances are maintained between mutually confronting edge portions 81(*o*) and 83(*o*). In this example, the final position of the diaphragm ring 33 is as shown in FIG. 7B, in which its upper face is in-line (or very nearly so) with the leading edges L(o) of the outer platforms 32 and the clearance X has closed up to a small nominal value.

Figure 7B:
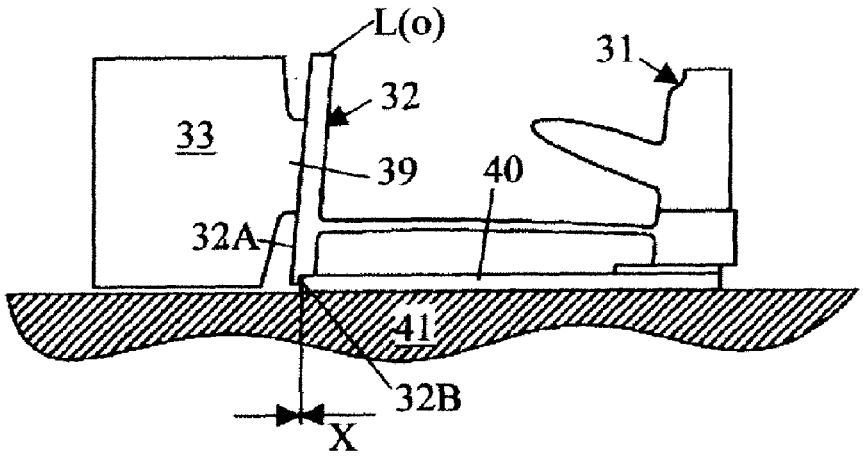

The diaphragm ring 33 can be forced down to the position shown in FIG. 7B by means of an array of clamps (not shown) that are equally spaced around the circumference of the diaphragm ring and act compressively between the table 41 and the diaphragm ring. As well as closing up the clearances between the confronting edge portions 84(*o*), 86(*o*) of neighbouring outer platforms, the radial compression produces an interference fit between the initially contacting edge portions 83(*i*) on neighbouring inner platforms of the blades, thereby putting the required degree of twist into the aerofoils. This pre-stressing of the blades favourably influences their dynamic behaviour in the diaphragm. Moreover, the interference fit between the edge portions 83(*i*) on the inner platforms produces a rigid band around the inner diameter of the completed diaphragm, thereby favourably influencing diaphragm dynamic behaviour.

An alternative way of closing up clearances between confronting edge portions 84(*o*) and 86(*o*) of neighbouring outer platforms would be to heat the assembled diaphragm ring 33 (and optionally also cool the ring of blades), place the diaphragm ring over the ring of blades, and then shrink the diaphragm ring onto the outer platforms as the diaphragm ring cools down. A further alternative way of achieving the same end would be to position the half-rings 33A, 33B (FIG. 5), one on each side of the ring of blades, insert the bolts and spacers, etc., 36A-36D, and gradually draw the half-rings together until their confronting end surfaces 101 meet, the appropriate interference between them being achieved by tightening the bolts to a predetermined value of torque.

To summarise, twisting of the aerofoils between the inner and outer platforms during assembly of the diaphragm 10 results in pre-stressing of the blades. This twisting is accomplished by:

oversizing (in comparison with the prior art of FIG. 8A) the inclined edge portions 83(*i*) on the inner platforms 31, initially assembling the annulus of blades so that inclined confronting edge portions 83(*i*) of neighbouring inner platforms 31 are in contact with each other, while the confronting edges 80(*o*) of neighbouring outer platforms 32 have clearances between them; and radially compressing the blade ring with the diaphragm ring 33 to a predetermined final diameter by forcible contact between the internal surface 39 of the diaphragm ring and the external surfaces 32A of the outer platforms, so that the clearances between confronting edge portions 84(*o*) and 86(*o*) of neighbouring outer platforms 32 are closed up, the contact between confronting edge portions 83(*i*) of neighbouring inner platforms 31 becomes an interference fit, and an elastic torsional stress is built into the aerofoils 30.

Note also the double contact design of the outer platforms, i.e., the contacts between confronting edge portions 84(*o*), 86(*o*) in the assembled condition that make differing angles of 90 degrees and 45 degrees, respectively, with the circumferential direction. This double contact prevents rotation of the outer platforms during the assembly process and ensures that the entire torsional load is built into the blade assembly, so that diaphragm ring 33 experiences only a radially outward load.

When the assembly process described with reference to FIGS. 7A and 7B has been accomplished, a second location plate 42 (see FIG. 9) is placed over the leading edges of the blade platforms, the second location plate having a diameter sufficient to overlap the inner diameter of the leading edges L(o) of the outer platforms. The second location plate is then clamped to the first location plate 40 by a number of nut and bolt arrangements (not shown) that pass through both location plates at equi-angularly spaced locations within the inner diameter of the inner platforms. Smaller clamps attached to the second location plate 42 hold the diaphragm ring 33 in the correct position against the taper for further processing.

Figure 9:
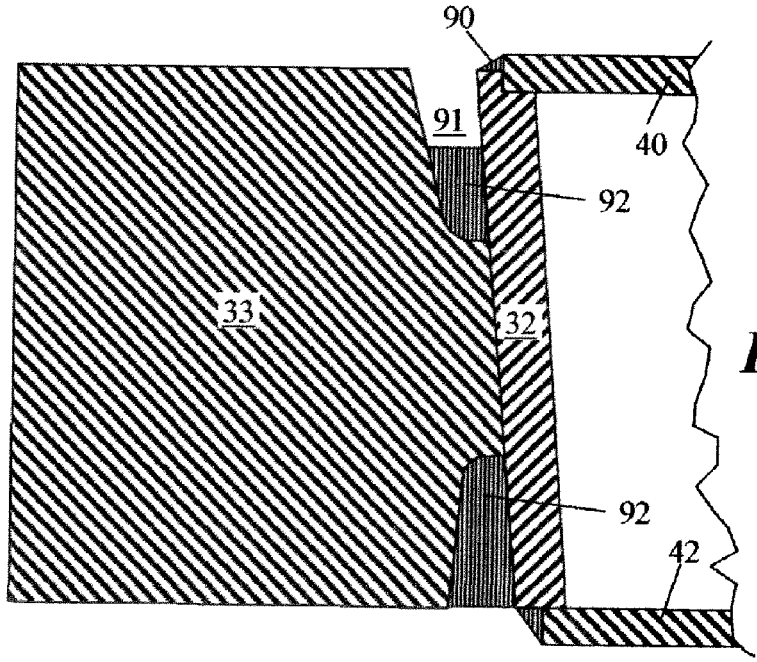
FIG. 9 is a diagrammatic radial section through the outer part of a turbine diaphragm during a welding process according to the invention.

After checking that the blades are in the correct positions, both of the location plates 40, 42 are welded to the outer platforms of the blades, as shown in FIG. 9 where triangular weld beads 90 are shown joining the location plates to the platform edges. This gives adequate support to the assembly during the main welding process, in which, as shown in FIG. 9, the diaphragm ring 33 is welded to the outer platforms 32 by filling in the annular spaces 91 between them with welds 92. Because the annular spaces 91 are axially deep, the welds 91 may be produced in two or more weld passes, the spaces 90 being partially filled during each weld pass. FIG. 9 shows the situation after three out of four weld passes, two weld passes having been completed on the platform leading edge side of the assembly and one weld pass having been completed on the platform trailing edge side of the assembly.

The above welding process will create stresses in the diaphragm assembly, so at this stage it should be heat treated to relieve the stresses. The location plates are then machined off the assembly.

Figure 10:
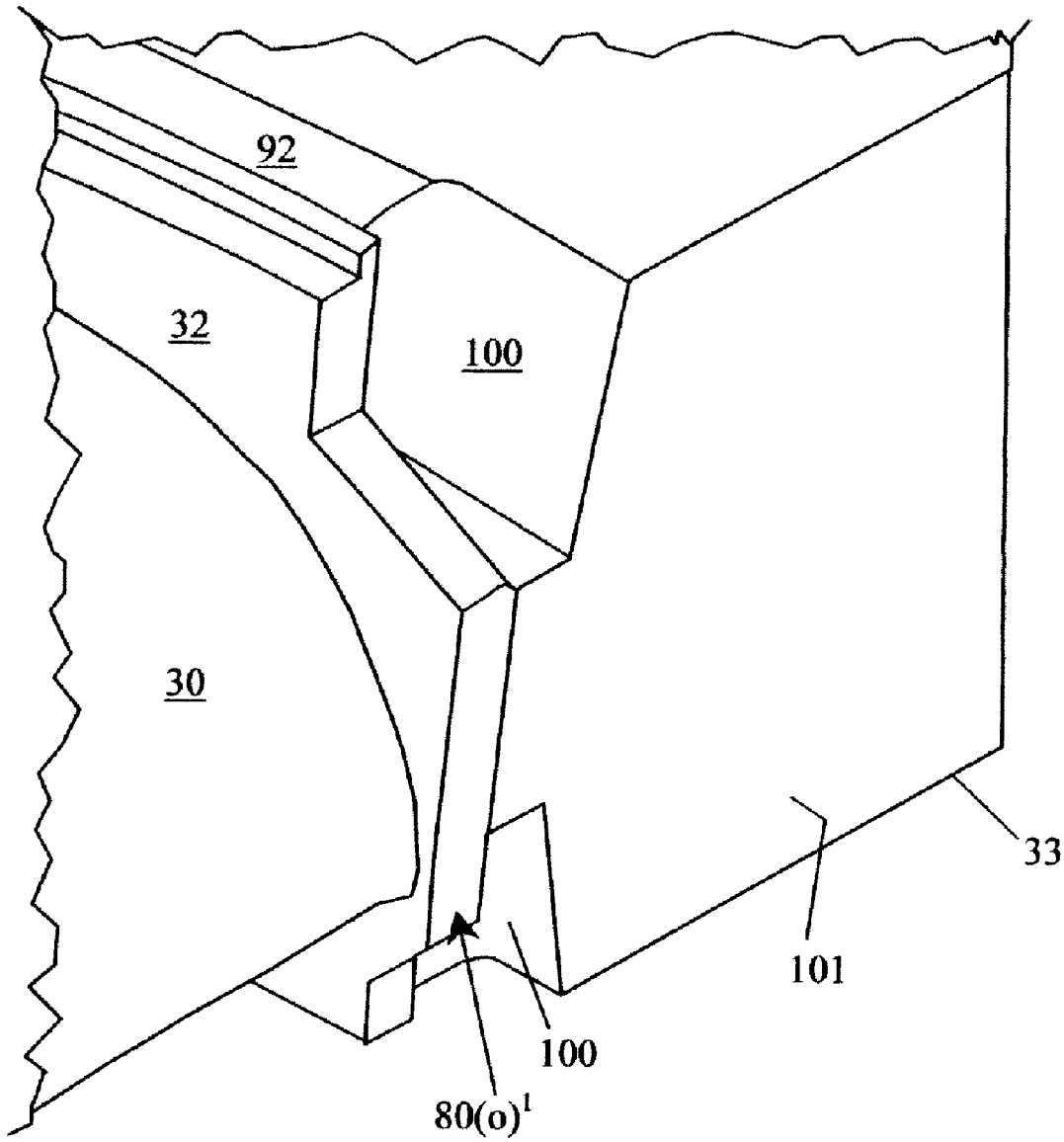
FIG. 10 is an isometric perspective view of the end of a half diaphragm after a machining process has been carried out on the welds of FIG. 9 to split the welded diaphragm into two halves for further machining.

To facilitate final machining of the inner and outer platforms 31, 32 and the diaphragm ring 33, thereby obtaining the final profiles indicated in FIGS. 2 and 6, it is necessary to split the diaphragm into two parts. This is also necessary for assembly and disassembly of the turbine. As shown in FIG. 10, splitting of the welded diaphragm into two half-diaphragms can done by machining pockets 100 into the deep welds 92 previously produced between the diaphragm ring 33 and the outer platforms 32, so that over a short circumferentially extending length of the welds 92 on both sides of the diaphragm, the weld material is completely removed. Provided the confronting edges 80$(o)^1$ of diametrically opposite pairs of the outer platforms 32 have been positioned correctly relative to the end surfaces 101 of the two halves 33A and 33B of the diaphragm ring (FIG. 5), and provided the circumferential extent of the machined pockets 100 is greater than the circumferential extent of the confronting edges 80$(o)^1$ of neighbouring outer platforms, the diaphragm will split into two parts when the stud and spacer arrangements 36 are removed.

The present invention has been described above purely by way of example, and modifications can be made within the scope of the invention. Other aspects of the invention also include any individual features described or implicit herein or shown or implicit in the drawings or any combination of any such features or any generalisation of any such features or combination, which extends to equivalents thereof. Thus, the breadth and scope of the present invention should not be limited by any of the above-described exemplary embodiments. Each feature disclosed in the specification, including the drawings, may be replaced by alternative features serving the same, equivalent or similar purposes, unless expressly stated otherwise.

Any discussion of the prior art throughout the specification is not an admission that such prior art is widely known or forms part of the common general knowledge in the field.

Unless the context clearly requires otherwise, throughout the description, the words "comprise", "comprising", and the like, are to be construed in an inclusive as opposed to an exclusive or exhaustive sense; that is to say, in the sense of "including, but not limited to".

What is claimed is:

1. A turbine diaphragm comprising:

an annulus of static blades, each static blade comprising an inner platform, an aerofoil, and an outer platform; and an outer diaphragm ring surrounding the annulus of static blades and welded to the outer platforms;

wherein the inner platforms together form an inner diaphragm ring, confronting edges of the inner platforms have an interference fit with each other, and the aerofoils are in a state of torsional stress between the inner and outer platforms;

wherein mutually confronting edges of neighbouring inner and outer platforms comprise an interlocking cranked shape when seen in plan view;

wherein confronting edges of the outer platforms comprise an interlocking double cranked shape when seen in plan view; and wherein each outer platform includes a leading edge and a trailing edge, wherein the mutually confronting edges of neighbouring outer platforms comprise, in sequence from the trailing edge to the leading edge of each outer platform:

(a) a first axially aligned edge portion, (b) a first edge portion inclined to the axial direction, (c) a second axially aligned edge portion, (d) a second edge portion inclined to the axial direction, and (e) a third axially aligned edge portion, wherein the first, second, and third axially aligned edge portions are circumferentially offset from each other to form first, second, and third axially extending crank shaped arms, the first inclined edge portion connecting the first and second axially aligned edge portions and the second inclined edge portion connecting the second and third axially aligned edge portions, the first and second inclined edge portions thereby forming first and second inclined crank shaped arms.

2. A turbine diaphragm according to claim 1, further comprising a tapered interface between an inner diameter of the diaphragm ring and an outer diameter of the outer platforms.

3. A turbine diaphragm according to claim 1, wherein each inner platform includes a trailing edge and a leading edge, and wherein the mutually confronting edges of neighbouring inner platforms comprise, in sequence from the trailing edge to the leading edge of each inner platform:

(a) a first axially aligned edge portion, (b) an edge portion that is inclined to the axial direction, and (c) a second axially aligned edge portion;

wherein the first and second axially aligned edge portions are circumferentially offset from each other to form first and second axially extending crank shaped arms, and the inclined edge portion connecting the first and second axially aligned edge portions forms an inclined crank shaped arm.

4. A turbine diaphragm according to claim 3, wherein the first and second axially aligned edge portions are of differing lengths.

5. A turbine diaphragm according to claim 4, wherein the first axially aligned edge portion is shorter than the second axially aligned edge portion.

6. A turbine diaphragm according to claim 3, wherein the inclined edge portion is inclined at a negative angle to the circumferential direction, degrees of arc away from the circumferential direction in an anti-clockwise sense being negative.

7. A turbine diaphragm according to claim 1, wherein the first, second, and third axially aligned edge portions are of differing lengths.

8. A turbine diaphragm according to claim 7, wherein the first axially aligned edge portion is shorter than the second axially aligned edge portion, and the third axially aligned edge portion is shorter than the first axially aligned edge portion.

9. A turbine diaphragm according to claim 1, wherein the first inclined edge portion is inclined at a negative angle to the circumferential direction, degrees of arc away from the circumferential direction in an anti-clockwise sense being negative, and the second inclined edge portion is inclined at a positive angle to the circumferential direction, degrees of arc away from the circumferential direction in a clockwise sense being positive.

10. A turbine diaphragm according to claim 9, wherein:

mutually confronting edges of neighbouring inner platforms comprise, in sequence from a trailing edge to a leading edge of each inner platform:

(a) a first axially aligned edge portion, (b) an edge portion that is inclined to the axial direction, and (c) a second axially aligned edge portion;

the axially aligned edge portions being circumferentially offset from each other to form first and second axially extending crank shaped arms and the inclined edge portion connecting the first and second axially aligned edge portions forms an inclined crank shaped arm;

and comprising:

(i) a clearance between the first axially aligned confronting edge portions of the inner platforms, (ii) a clearance between the second axially aligned confronting edge portions of the inner platforms, and (iii) an interference contact between the inclined confronting edge portions of the inner platforms.

11. A turbine diaphragm according to claim 10, further comprising:

(a) a clearance between the first axially aligned confronting edge portions of the outer platforms, (b) a clearance between the first inclined confronting edge portions of the outer platforms, (c) a clearance between the third axially aligned confronting edge portions of the outer platforms, (d) contact between the second axially aligned confronting edge portions of the outer platforms, and (e) contact between the second inclined confronting edge portions of the outer platforms.

12. A method of manufacturing a turbine diaphragm, the turbine diaphragm including an outer diaphragm ring and an annulus of aerofoil blades having radially inner and outer platforms formed integrally with aerofoils, neighbouring inner and outer platforms having mutually confronting edges that form interlocking cranked shapes when seen in plan view, the method comprising:

initially assembling the annulus of blades so that selected confronting edge portions of neighbouring inner platforms are in contact with each other, while all confronting edge portions of neighbouring outer platforms have clearances between them; and radially compressing the annulus of blades with the outer diaphragm ring to a predetermined final diameter by forcible contact between an internal surface of the diaphragm ring and external surfaces of the outer platforms, so that clearances between selected confronting edge portions of the neighbouring outer platforms are closed up, the contact between the selected confronting edge portions of the neighbouring inner platforms becomes an interference fit, and an elastic torsional stress is formed in the aerofoils.

13. A method of manufacturing a turbine diaphragm according to claim 12, further comprising welding the diaphragm ring to the outer platforms.

14. A method of manufacturing a turbine diaphragm according to claim 13, further comprising splitting the welded assembly into two parts along a diameter to facilitate final machining and assembly of the diaphragm into a turbine.

15. A method of manufacturing a turbine diaphragm according to claim 12, further comprising pre-forming the selected confronting edge portions of neighbouring outer platforms such that they each comprise an edge portion that is axially aligned and an edge portion that is inclined with respect to the circumferential direction, so that the entire torsional load in the diaphragm assembly is confined to the blade annulus and only a radially outward load from the blade annulus is experienced by the diaphragm ring.

* * * * *